US007025634B1

(12) United States Patent
Swantner et al.

(10) Patent No.: US 7,025,634 B1
(45) Date of Patent: Apr. 11, 2006

(54) LAMP SOCKET

(75) Inventors: Michael J. Swantner, Warren, PA (US); Douglas G. Seymour, York, PA (US); Michael Scholeno, Lakewood, NY (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/130,324

(22) Filed: May 16, 2005

(51) Int. Cl.
*H01J 1/00* (2006.01)

(52) U.S. Cl. ..... 439/619; 439/699.2; 439/833; 439/839

(58) Field of Classification Search ..... 439/619, 439/699.2, 833, 839, 682, 683, 684, 830, 439/831, 832

See application file for complete search history.

(56) References Cited

U.S. PATENT DOCUMENTS 4,391,485 A * 7/1983 Urani ..... 439/687
4,472,018 A * 9/1984 Urani ..... 439/814
5,120,242 A * 6/1992 Greiler et al. ..... 439/683

* cited by examiner

*Primary Examiner*—Ross Gushi
(74) *Attorney, Agent, or Firm*—William H. McNeill

(57) ABSTRACT

A socket (40) for a bi-pin lamp (41) has a primary housing (42) including a receptacle (44): a secondary housing (46) formed to be received in the receptacle (44), the secondary housing (46) having a body (48) with a pair of recesses (50) therein; a floor (52) in the recesses (50); a pin-receiving aperture (54) in the floor of each of the recesses (50); and an electrical contact (10) positioned in each recess (50), the electrical contact (10) comprising a substantially U-shaped body (12) having an open end (14) and a bight (16), the U-shaped body (12) comprising a substantially U-shaped contact portion (18) formed of a first material nested within a substantially U-shaped contiguous spring portion (20) formed of a second material.

4 Claims, 4 Drawing Sheets

LAMP SOCKET

TECHNICAL FIELD

This invention relates to lamp sockets and more particularly to lamp sockets for bi-pin lamps. Still more particularly, it relates to lamp sockets utilizing novel electrical contacts.

BACKGROUND ART

Previous lamp sockets for bi-pin lamps have employed tangential contacts, which forced the contact points to change dramatically as the mating lamp pin was inserted, producing and increasing insertion force as the pin was inserted into the socket. This condition made it difficult to determine if the bulb was completely seated in the socket. Additionally, prior contacts often had to be plated to achieve the high conductance levels needed to transmit high current levels to the lamp. The plating was subject to wear, thus limiting the life of the socket.

DISCLOSURE OF INVENTION

It is, therefore, an object of the invention to obviate the disadvantages of the prior art.

It is another object of the invention to enhance the seating of bi-pin lamps into an appropriate socket.

It is yet another object of the invention to lengthen socket life.

These objects are accomplished, in one aspect of the invention, by the provision of an electrical contact comprising a substantially U-shaped body having an open end and a bight, the U-shaped body comprising a contact portion formed of a first material nested within a substantially contiguous spring portion formed of a second material. This two-piece contact design allows the contact to be compliant for an entire range of tolerances. Further, it allows the contact to have a material with a relatively high conductance for contacting the mating lamp pin. The terminal does not require plating, thus providing extremely long life.

The objects are further accomplished by the provision of socket for a bi-pin lamp. The socket comprises an electrically insulating primary housing including a receptacle, and a secondary housing formed to be received in the receptacle. The secondary housing has a body with a pair of recesses therein. The recesses have a floor including a pin-receiving aperture. A substantially U-shaped electrical contact is positioned in each recess with the open ends thereof facing the floor, each of the electrical contacts comprising a contact portion formed of a first material nested within a substantially contiguous spring portion formed of a second material.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
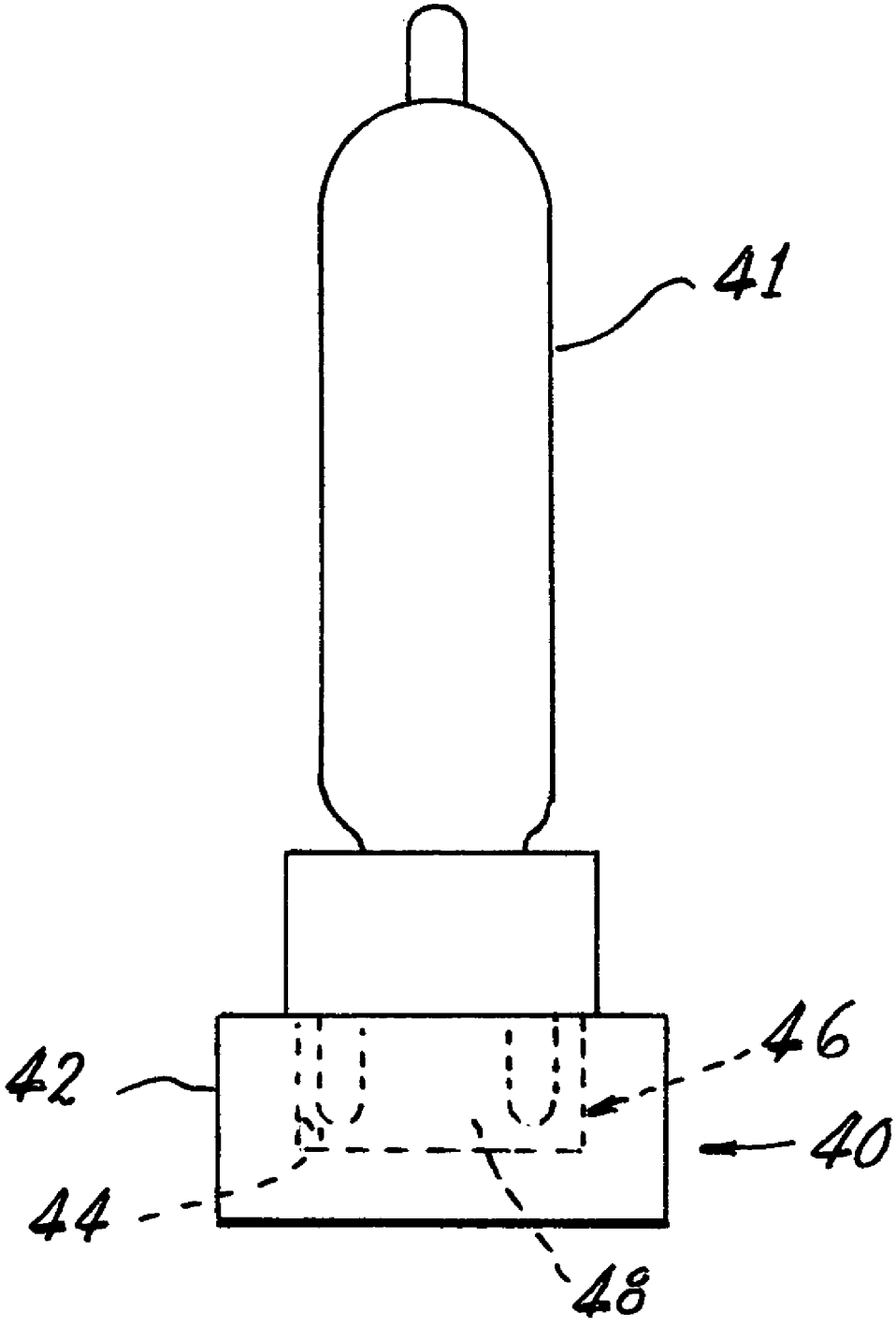
FIG. 1 is a diagrammatic elevational view of a bi-pin lamp and socket assembly.
Figure 2:
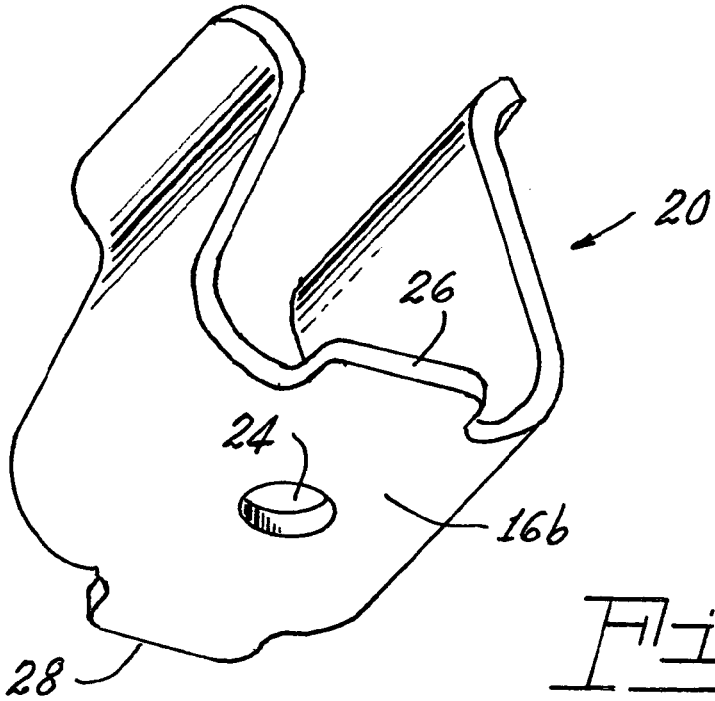
FIG. 2 is a perspective view of the spring portion of an electrical contact according to an aspect of the invention.
Figure 3:
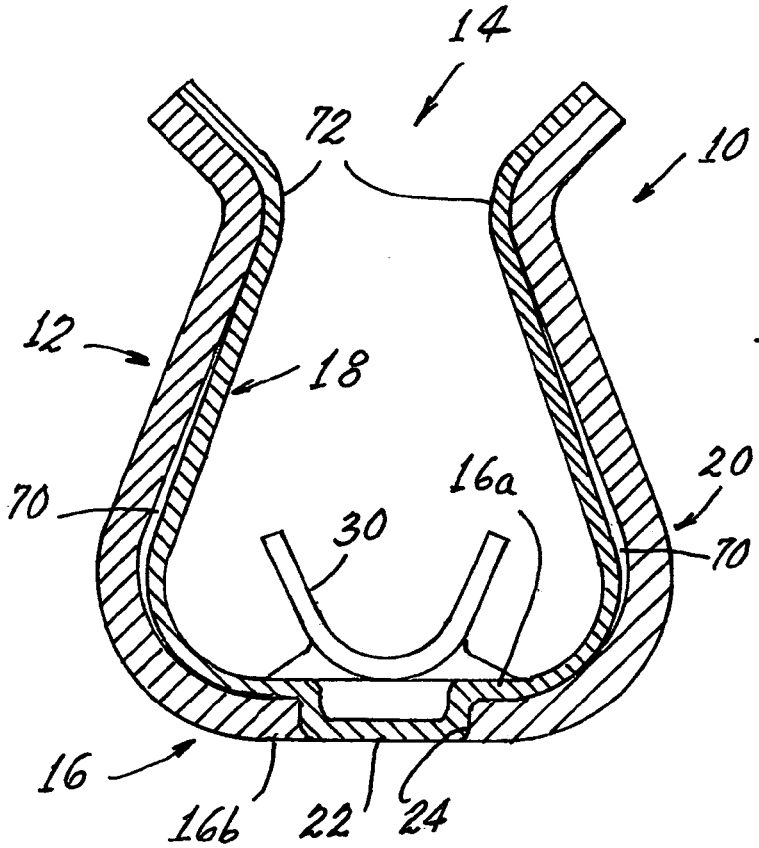
FIG. 3 is a vertical sectional view of an assembled electrical contact according to an aspect of the invention.

Referring now to the drawings with greater particularity, there is shown in FIG. 1 a socket 40 for a bi-pin lamp 41. The socket 40 comprises a primary housing 42, formed, for example, from aluminum, and including a receptacle 44. A secondary housing 46 (see FIGS. 4–7) of a suitable ceramic material such as L-3 Steatite is formed to be received in the receptacle 44, the secondary housing 46 having a body 48 with a pair of recesses 50 therein. A floor 52 is provided in the recesses 50 and a pin-receiving aperture 54 is provided in the floor of each of the recesses 50. An electrical contact 10 (see FIG. 3) is positioned in each recess 50. Each electrical contact 10 comprises a substantially U-shaped body 12 having an open end 14 and a bight 16. The U-shaped body 12 is a two-piece construction comprising a substantially U-shaped contact portion 18 formed of a first material, for example, nickel, nested within a substantially U-shaped contiguous spring portion 20 formed of a second material, such as heat-treated stainless steel.

The contact portion 18 of the electrical contact 10 has a protrusion 22 formed in the bight 16*a* thereof, the protrusion 22 being fitted into a matching opening 24 in the bight 16*b* of the spring portion 26. The protrusion 22 can be formed during the formation of the contact portion 18 and be friction-fitted into the opening 24 or, preferably, it can be formed directly into the opening 24, as by a coining operation after the contact portion and the spring portion are nested together.

Figure 4:
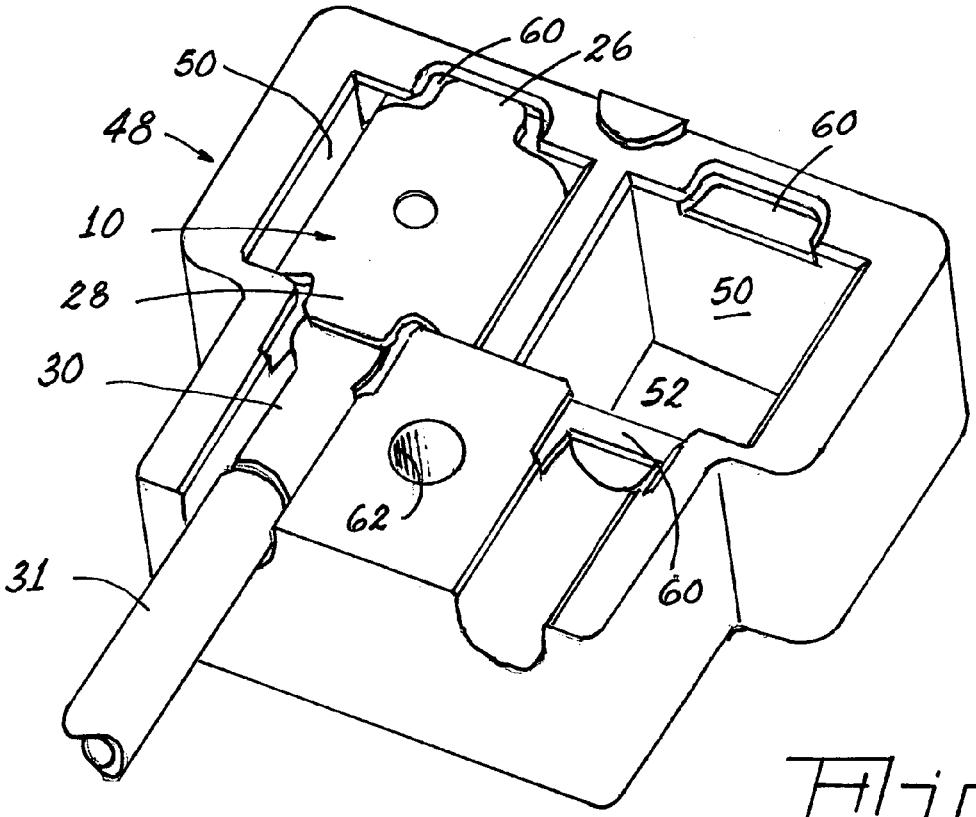
FIG. 4 is a perspective view of a secondary housing with a single electrical contact positioned therein.
Figure 5:
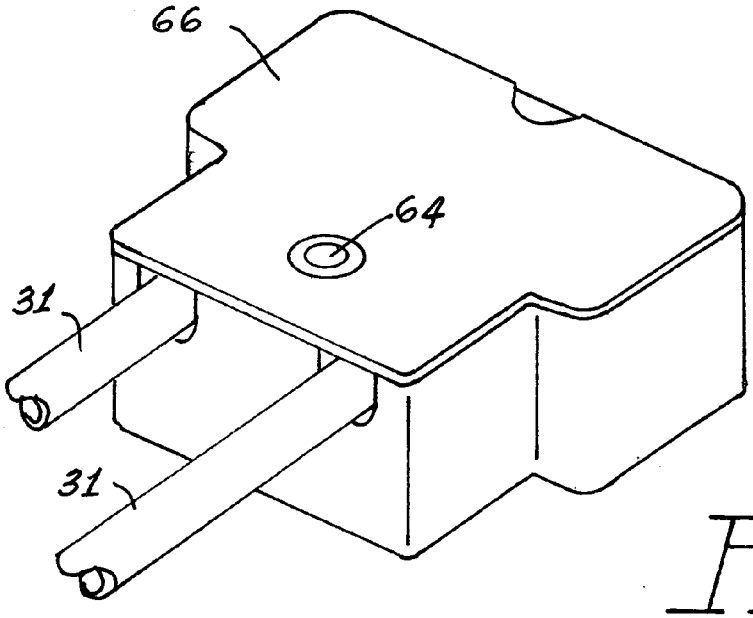
FIG. 5 is a perspective view of the underside of a secondary housing with a cover in place.
Figure 6:
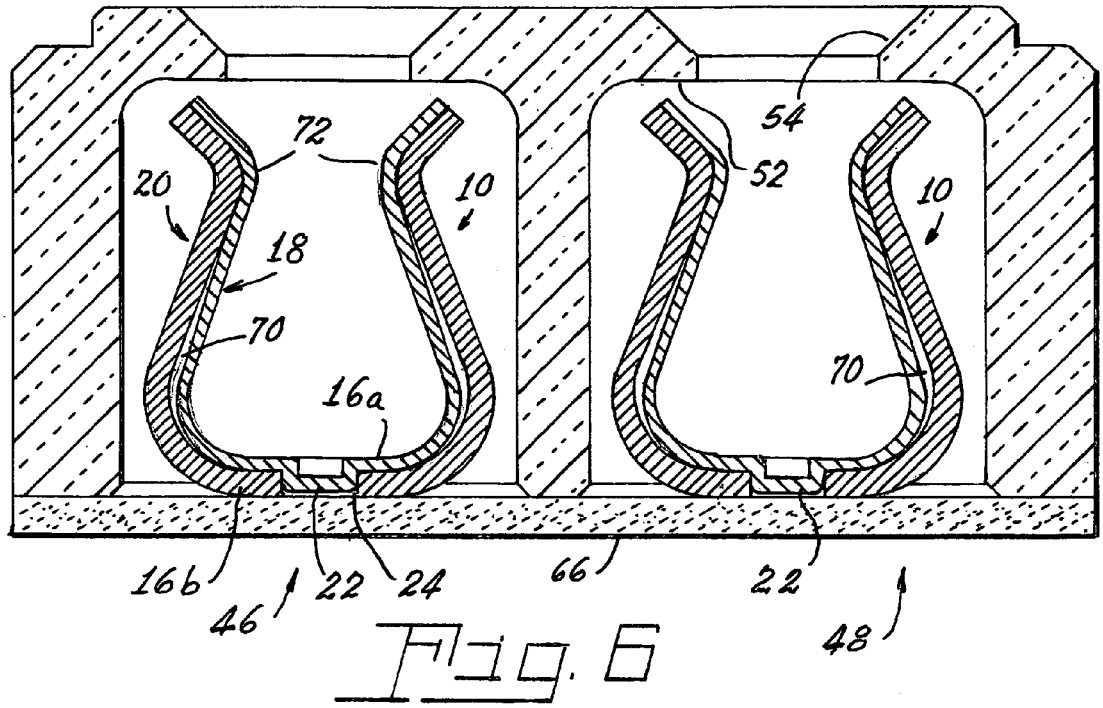
FIG. 6 is an elevational sectional view of an assembled secondary housing.
Figure 7:
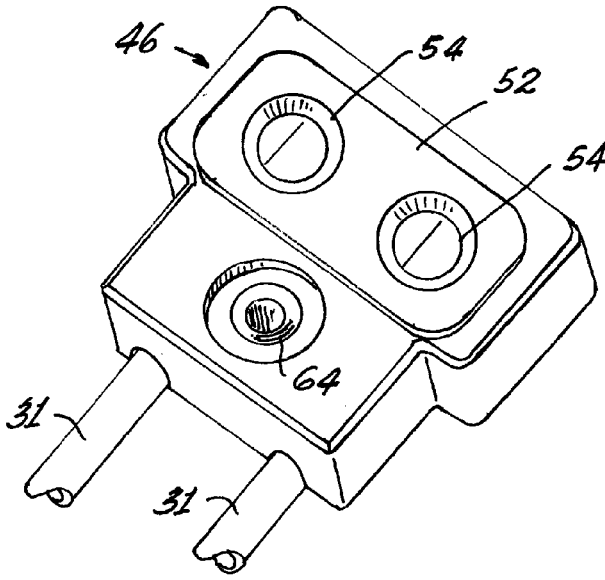
FIG. 7 is a perspective view of an assembled secondary housing before assembly into a socket.

The bights 16*a* and 16*b* of the contact portion 18 and the spring portion 20 include first and second oppositely directed tabs 26, 28 that, in the case of tabs 26, fit into slots 60 in recesses 50 to aid in locating and stabilizing the contact 10 and allow it to float in the recess and, in the case of tabs 28, provide support for the projecting wire-engaging member 30 that is formed on bight 16*a* of the contact portion 18 as an extension of a tab 28. These features are illustrated in FIG. 4. As shown, the wire-engaging member 30 is formed to crimp the center conductor of a wire 31; however, the wire-engaging member 30 could also be formed as flat tab with the center conductor of a wire 31 welded to it.

The secondary housing 46 includes a through-hole 62 to receive a rivet 64 or other fastening device for securing an electrically insulating cover 66 formed, for example, of mica, to the housing 46 to maintain the contacts 10 within the recesses 50.

A gap 70 exists between the contact portion 18 and the spring portion 20 near the bight 16 to insure that spring portion 20 and contact portion 18 are touching at the pin engagement area 72.

Thus there is provided an enhanced bi-pin lamp socket whose dual cantilevered beam design provides two well defined points of contact for the mating pins. Further, the two-piece design allows the contact to be compliant through an entire range of tolerances while also allowing for the use of a contact material having a relatively high conductance mate with the pins. The contact does not require plating to achieve this effect thereby greatly extending the life of the contact.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A socket for a bi-pin lamp comprising:

a primary housing including a receptacle:

a secondary housing formed to be received in said receptacle, said secondary housing having a body with a pair of recesses herein;

a floor in said recesses;

a pin-receiving aperture in the floor of each of said recesses; and a substantially U-shaped electrical contact positioned in each recess with the open ends thereof facing said floor, each of said electrical contacts comprising a contact portion formed of a first material nested within a substantially contiguous spring portion formed of a second material, said contact portion having a protrusion formed in the bight thereof, said protrusion being fitted into a matching opening in said spring portion.

2. The socket of claim 1, wherein the bight of said spring portion of said electrical contact includes first and second oppositely directed tabs.

3. The socket of claim 2 wherein said recesses in said secondary housing include slots for receiving said tabs.

4. The socket of claim 3 wherein the bight of said contact portion includes a projecting wire-engaging member.

* * * * *